US007344104B2

(12) United States Patent
Hada et al.

(10) Patent No.: US 7,344,104 B2
(45) Date of Patent: Mar. 18, 2008

(54) UNWIND APPARATUS

(75) Inventors: Frank Stephen Hada, Appleton, WI (US); James Leo Baggot, Menasha, WI (US); Brian James Gingras, Appleton, WI (US); Vivek Karandikar, Neenah, WI (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 396 days.

(21) Appl. No.: 11/102,014

(22) Filed: Apr. 8, 2005

(65) Prior Publication Data

US 2006/0226275 A1 Oct. 12, 2006

(51) Int. Cl.
*B65H 23/06* (2006.01)

(52) U.S. Cl. ..... 242/420.2; 242/535.4; 242/541.3

(58) Field of Classification Search ..... 242/420.2, 242/421.1–421.4, 541, 541.3, 542.2, 535.4, 242/563
See application file for complete search history.

(56) References Cited

U.S. PATENT DOCUMENTS 2,342,203 A 2/1944 Kohler
2,367,777 A * 1/1945 Hornbostel ..... 242/420.2
2,692,091 A 10/1954 Kohler
2,892,597 A 6/1959 Schmidt
5,150,850 A * 9/1992 Adams ..... 242/541.3
5,906,333 A 5/1999 Fortuna et al.
6,101,691 A * 8/2000 Pace et al. ..... 26/70
6,332,589 B1 * 12/2001 Moller et al. ..... 242/541.3
6,490,762 B1 * 12/2002 Siegenthaler et al. ..... 19/161.1
6,719,240 B2 4/2004 Hanson et al.
2007/0023561 A1 * 2/2007 Kemppainen et al. ... 242/532.3

* cited by examiner

*Primary Examiner*—Peter M. Cuomo
*Assistant Examiner*—Sang Kim
(74) *Attorney, Agent, or Firm*—Scott A. Baum; Gregory E. Croft

(57) ABSTRACT

By designing a belt-driven unwind to have two distinct belt tension areas, the belt pressure against the unwinding roll can be decreased. The belt-driven unwind can have a higher belt tension section for proper belt tracking and to prevent slippage at the drive roller, and the belt driven unwind can have a lower belt tension section for the portion of the belt in contact with the unwinding roll. In this manner, the belt-driven unwind can be used with soft, bulky tissue rolls without damaging the rolls like a conventional belt-driven unwind.

13 Claims, 3 Drawing Sheets

UNWIND APPARATUS

BACKGROUND

Materials, such as fluff, padding, paper, board, and tissue are often wound into a roll and then stored for subsequent processing operations. During the subsequent processing operation, the roll is unwound and the sheet material is run through another machine for further processing steps. A common unwind used for rolls of soft, compressive, and relatively weak materials, such as facial tissue, bath tissue, paper toweling and the like, uses one or more belts that contact at least a portion of the roll's periphery. These unwinds are commonly referred to as a belt-driven unwind. The surface contact between the belt(s) and the roll transmits the drive force needed to accelerate, decelerate, and rotate the roll. The belt(s) are driven by a drive roller connected to a power source, such as a drive motor, that accelerates, decelerates, or rotates the belt(s) that are wrapped around at least a portion of the drive roller's surface. In order to ensure proper belt tracking and to prevent slippage of the belt(s) at the drive roller, the belt tension must be kept at a higher level for proper operation of the belt-driven unwind.

For some tissue materials, a belt-driven unwind is not suitable since the belt's pressure against the outer surface of the roll can cause grooves to appear in the roll, thereby damaging the underlying tissue. Such damage is more common with high bulk, soft tissue products used by individual consumers as opposed to lower bulk tissue products commonly sold to the service and industrial markets. The pressure of the belt(s) against the roll occurs since the belt tension can only be reduced to a minimum value before belt tracking and slippage of the belt(s) prevent further reductions in the belt tension. Additionally, to prevent slippage of the roll at the roll/belt interface, the belts must be loaded against the roll's surface with sufficient force to generate the drive forces needed. Often the belts are wrapped around a significant portion of the roll's periphery. These factors contribute to a minimum pressure for the belt(s) against the surface of the roll that cannot be reduced without creating runnability problems, i.e. belt and/or roll slippage, especially during acceleration of a maximum diameter roll. Thus, it is seen that there are conflicting requirements for belt tension. The belt needs to be tight for guiding and to transmit power to the roll, but high belt tension can damage soft, bulky rolls of material.

One means of preventing this damage is to use a center-driven unwind. One suitable center-driven unwind for soft tissue rolls is disclosed in U.S. Pat. No. 5,906,333, entitled Center Drive Unwind System and issued to Fortuna et al. on May 25, 1999. Another suitable unwind for soft tissue rolls is a combination center-driven and belt-driven unwind disclosed in U.S. Pat. No. 6,719,240, entitled System and Method for Unwinding Tissue Webs and issued to Hanson et al. on Apr. 13, 2004. Center-driven unwinds have a disadvantage in that they are generally more expensive than the belt-driven unwinds. Draw control or tension control of the sheet material can be more difficult with a center-driven unwind than with a belt-driven unwind because the rotational speed of the roll must be continually changed as the roll unwinds to maintain a fixed sheet velocity at the outside perimeter of the roll. Out-of-round rolls also experience tension variations as the rolls unwind since center-driven unwinds may not be able to adjust for diameter variations of the roll within a single revolution of the roll. Center-driven unwinds can also experience slippage at or near the core when trying to accelerate large diameter, softly wound tissue rolls since the power to turn the roll must be transmitted from the core through the roll. Therefore, what is needed is a belt-driven unwind that is suitable for use with soft, bulky materials that can replace or be used in combination with a center-driven unwind.

SUMMARY

The inventors have discovered that by designing the belt-driven unwind to have two distinct belt tension areas, the belt pressure against the unwinding roll can be decreased. Thus, the belt-driven unwind can have a higher belt tension section for proper belt tracking and to prevent slippage at the drive roller, and the belt driven unwind can have a lower belt tension section for the portion of the belt in contact with the unwinding roll. In this manner, the belt-driven unwind can be used with soft, bulky tissue rolls without damaging the rolls like a conventional belt-driven unwind.

Hence, in one aspect, the invention resides in an apparatus including: a drive roller, a brake roller, and an endless belt configured for rotation about the drive roller and the brake roller along an endless belt path; and wherein the drive roller advances the endless belt while the brake roller retards the endless belt so as to create at least a portion of the endless belt's path having a lower tension and another portion of the endless belt's path having a higher tension.

In another embodiment, the invention resides in a method including: providing a drive roller, a brake roller, and an endless belt configured for rotation about the drive roller and the brake roller along an endless belt path; advancing the drive roller; retarding the brake roller; creating at least a portion of the endless belt's path having a lower tension; and creating another portion of the endless belt's path having a higher tension.

BRIEF DESCRIPTION OF THE DRAWINGS

The above aspects and other features, aspects, and advantages of the present invention will become better understood with regard to the following description, appended claims, and accompanying drawings in which:

Figure 1:
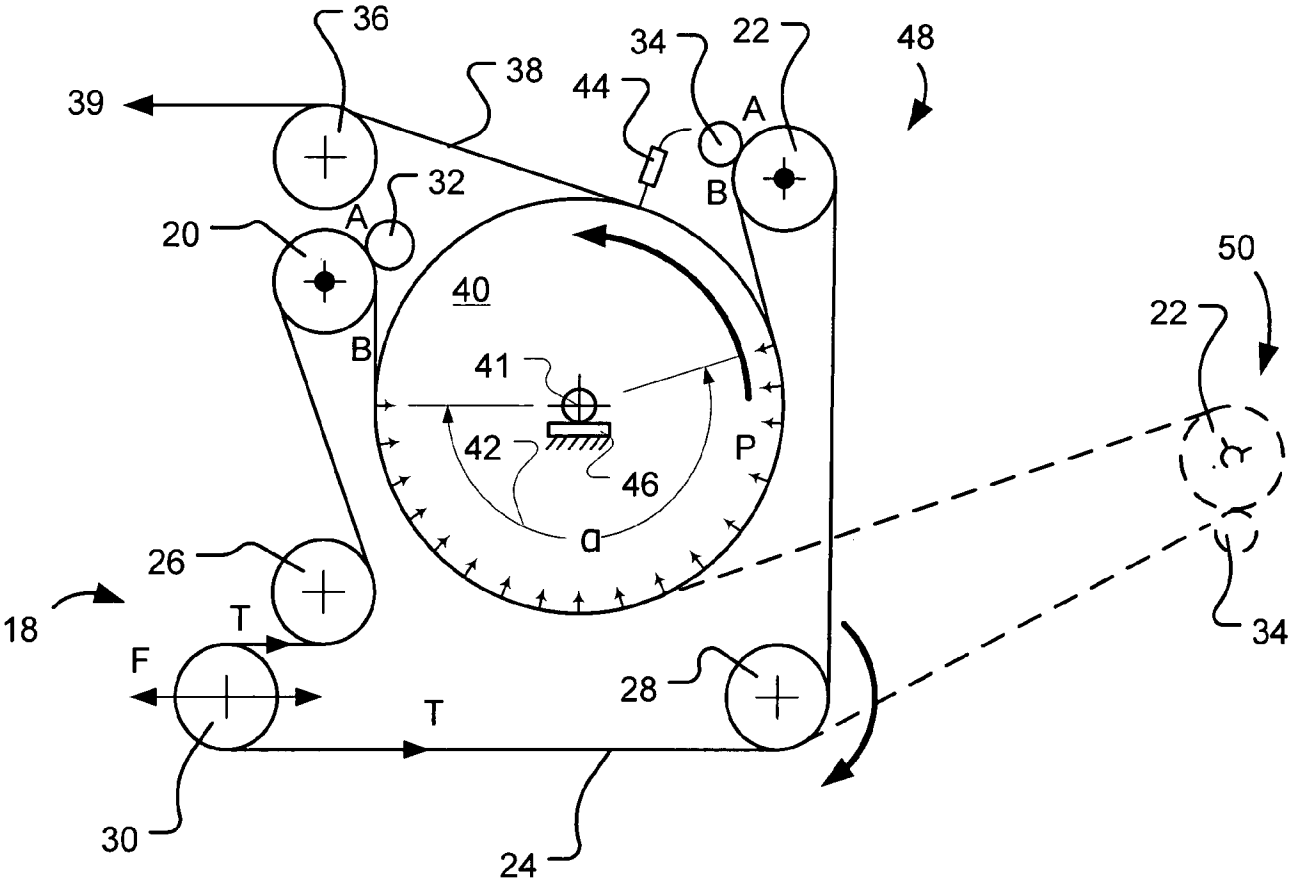
FIG. 1 illustrates an unwind apparatus of the present invention.

Repeated use of reference characters in the specification and drawings is intended to represent the same or analogous features or elements of the invention.

DEFINITIONS

As used herein, forms of the words "comprise", "have", and "include" are legally equivalent and open-ended. Therefore, additional non-recited elements, functions, steps, or limitations may be present in addition to the recited elements, functions, steps, or limitations.

DETAILED DESCRIPTION

It is to be understood by one of ordinary skill in the art that the present discussion is a description of exemplary embodiments only and is not intended as limiting the broader aspects of the present invention, which broader aspects are embodied in the exemplary construction.

Referring now to FIG. 1, one embodiment of the belt-driven unwind 18 is illustrated. The belt-driven unwind 18 includes at least one drive roller 20, at least one brake roller 22, and at least one endless belt 24. The belt-driven unwind 18 may also have one or more guide rollers 26, 28 for guiding the belt(s), one or more stretch rollers 30 for taking up the belt(s) slack as the roll unwinds, and one or more nip rollers 32, 34 for isolating the belt tension between the higher belt tension area and the lower belt tension area. The belt-driven unwind 18 may further include a lead-in roller 36 for feeding the sheet material, such as tissue web 38, to a machine 39 (not shown) for further processing. The belt-driven unwind 18 also includes a frame (not shown) of sufficient rigidity for supporting the rollers and a roll of sheet material 40 in the locations illustrated. In one embodiment, the roll was a tissue roll.

During operation of the inventive belt-driven unwind, a higher belt tension is induced between points A-A of the belt's travel path. This is done by powering the drive roller 20 at the required line speed to match the acceleration or draw required to feed the tissue web 38 to the machine 39. Drive roller 20 may be driven by a line shaft, a harmonic drive, an electric drive motor, or by other means known to those of skill in the art. Simultaneously, the brake roller 22 is braked by a mechanical brake (brake pads on a drum or rotor), a hydraulic brake (hydraulic pump forcing oil through a variable orifice), a magnetic brake, an electrical drive operating in a regenerative mode, or by other means known to those of skill in the art. By operating the drive roller 20 and the brake roller 22 in this manner, a higher belt tension is induced between points A-A of the belt path (guide rollers 26, 28, and stretch roller 30), and a lower belt tension or even no belt tension is induced between points B-B of the belt path (the belt path from the exit of drive nip roller 32 to the entry of brake nip roller 34). In this manner, the guide rollers (26, 28) and the stretch roller 30 can be placed within the higher belt tension path A-A to insure proper tracking and control of the belt(s).

During deceleration, the functionality of the drive roller 20 and the brake roller 22 may reverse depending on the rate of deceleration and the inertia of the roll 40. The drive roller 20 may be braked to decelerate the roll 40 and the brake roller 22 driven to maintain a lower belt tension in path B-B. The drive controls can be adjusted to accommodate decelerating a large diameter roll 40 quickly while maintaining a lower belt tension in path B-B.

Since the roll 40 is now located in the lower belt tension path B-B, the pressure P exerted on the roll's surface from the vector component of the belt's tension acting on the roll can be reduced or eliminated. By controlling the torque split between the drive roller 20 and the brake roller 22, the belt tension in path B-B can be adjusted higher or lower. Stated in another manner, the tissue roll 40 could be removed from the unwind 18, and the belt 24 could be run with a loop between the drive roller 20 and the brake roller 22. In this manner, the pressure P exerted on the roll's surface can be controlled as a function of the force F exerted by the stretch roller 30 that is above the force needed to hold the roller in place due to the belt tension in path A-A. Since, in the illustrated embodiment, the belt 24 wraps the stretch roller approximately 180 degrees, any force F larger than 2T (belt tension force) will result in a pressure P being applied to the surface of the roll 40. Additional pressure P can be applied to the roll's surface by varying the amount of braking done by the brake roller 22 to create more or less belt tension in portion B-B of the belt's path or even no belt tension in this portion of the belt's path.

The inventive belt-driven unwind 18 can also include a roll diameter and/or sheet velocity sensor 44. The sensor can either contact the sheet material, be attached to a core chuck or a core shaft 41 supporting the roll 40, or utilize a non-contacting sensor such as a laser roll diameter and/or sheet velocity sensor. The speed information can be used by an automatic control system to adjust the force F applied by the stretch roller 30. By comparing the actual sheet velocity to the velocity set point, roll 40 slippage can be detected. When slippage starts to occur, the force F applied to the stretch roller can be increased to increase the pressure P applied to the roll 40 by the belt 24. In this manner, the absolute minimum pressure P needed to drive the roll 40 without slippage can be applied by automatically adjusting the force F with the automatic control system.

Alternatively, or in combination with the speed sensor 44, the inventive belt-driven unwind can also include at least one load cell 46, and preferably two load cells, positioned between the core chucks or the core shaft 41 supporting the roll 40 and the frame of the belt-driven unwind at one or both ends of the roll. The load cells can be used in an automatic control system to adjust the force F applied to the stretch roller 30. Since the roll's diameter can be determined by the position of the stretch roller 30 and the tare weight of the core shaft 41 is known, the current weight of the roll 40 can be calculated if the basis weight or density of the sheet material is known. Since the pressure P will tend to reduce the forces acting on the load cell due to the roll's weight by lifting the roll 40, the difference in the load cell reading between the expected weight of the roll based on the current diameter and the actual weight of the roll as measured by the load cell can be determined. A pre-selected difference between the calculated weight and the measured weight can be used as a set point in an automatic control system to control the force F applied by the stretch roller 30 thereby controlling the pressure P applied to the roll 40.

The inventive unwind can also be run in a basic operating mode by setting a fixed torque differential between the drive roller 20 and the brake roller 22 to create a lower belt tension during the B-B portion of the belt's travel. The stretch roller 30 can then be set to a fixed force F greater than the force acting on the stretch roller from the belt's tension in the high belt tension path A-A of the belt's travel. Depending on the force F selected, and the torque differential selected, the pressure P applied to the roll can be set to a specific fixed value. Alternatively, the torque differential and/or stretch roller force can be programmed to vary as a function of the roll's diameter by an automatic control system without the use of a feedback speed loop or weight loop—i.e. open loop control of the torque split and force F.

Depending on the maximum wrap angle $\alpha$, one or more of the rollers in the belt-driven unwind may need to either rotate or translate or both rotate and translate to a new position for loading a new roll 40 into the unwind. In the illustrated embodiment, the brake roller 22 and nip roller 34 are mounted onto arms (not shown) that can pivot between the running position 48 and the loading position 50. Other mechanical elements known to those of skill in the art can be used to change the positions of one or more rollers in the belt-driven unwind for the purpose of either loading a new roll, unloading an existing roll, or unloading a core shaft 41 from the unwind 18.

In the embodiment illustrated in FIG. 1, the drive nip roller 32 and the brake nip roller 34 are used to isolate the higher (A-A) and lower (B-B) belt tension paths and to ensure high levels of traction between the belt 24 and the rollers (20, 22) is present to prevent slippage. This can be done by applying a sufficient force to each nip roller to pinch the belt 24 in the respective nip, preventing belt slippage about either the drive roller 20 or the brake roller 22. Suitable mechanical elements such as one or more hydraulic cylinders attached to the nip roller or attached through linkages attached to the nip roller can be used to load the respective nip roller against the opposing roller.

While the nip rollers (20, 22) can be located at any position about the drive roller 20 or the brake roller 22 that the belt 24 wraps, preferably the nip rollers are located near the belt's exit off the drive roller 20 and near belt's entrance onto the brake roller 22, as shown in FIG. 1. In this manner, the higher belt tension path A-A, wraps a significant portion of the periphery of the drive and brake rollers (20, 22). By including the belt's wrap on the drive and brake roller (20, 22) in the higher tension belt path A-A, belt slippage can be reduced with less nip load and improved belt tracking can result. Alternatively, the nip rollers (32, 34) can be located such that the belt's wrap, or any portion thereof, about the drive roller 20 and brake roller 22 is in the low belt tension path B-B. To maximize a low belt tension wrap, the drive nip roller 32 can be located near the belt's entrance onto drive roller 20 and the brake nip roller 34 can be located near the belt's exit from the brake roller 22.

Alternatively, or in combination with the nip rollers, high coefficient of friction coatings can be applied to the drive roller 20 or the brake roller 22. A high coefficient of friction belt material can be used. The wrap angles on the drive roller 20 and brake roller 22 can be increased. The nip rollers can be replaced with additional guide rollers to isolate the two belt tension areas, or self-actuating nip rollers can be used such that the belt's tension tends to load the nip roller more against the opposing roller.

Figure 2:
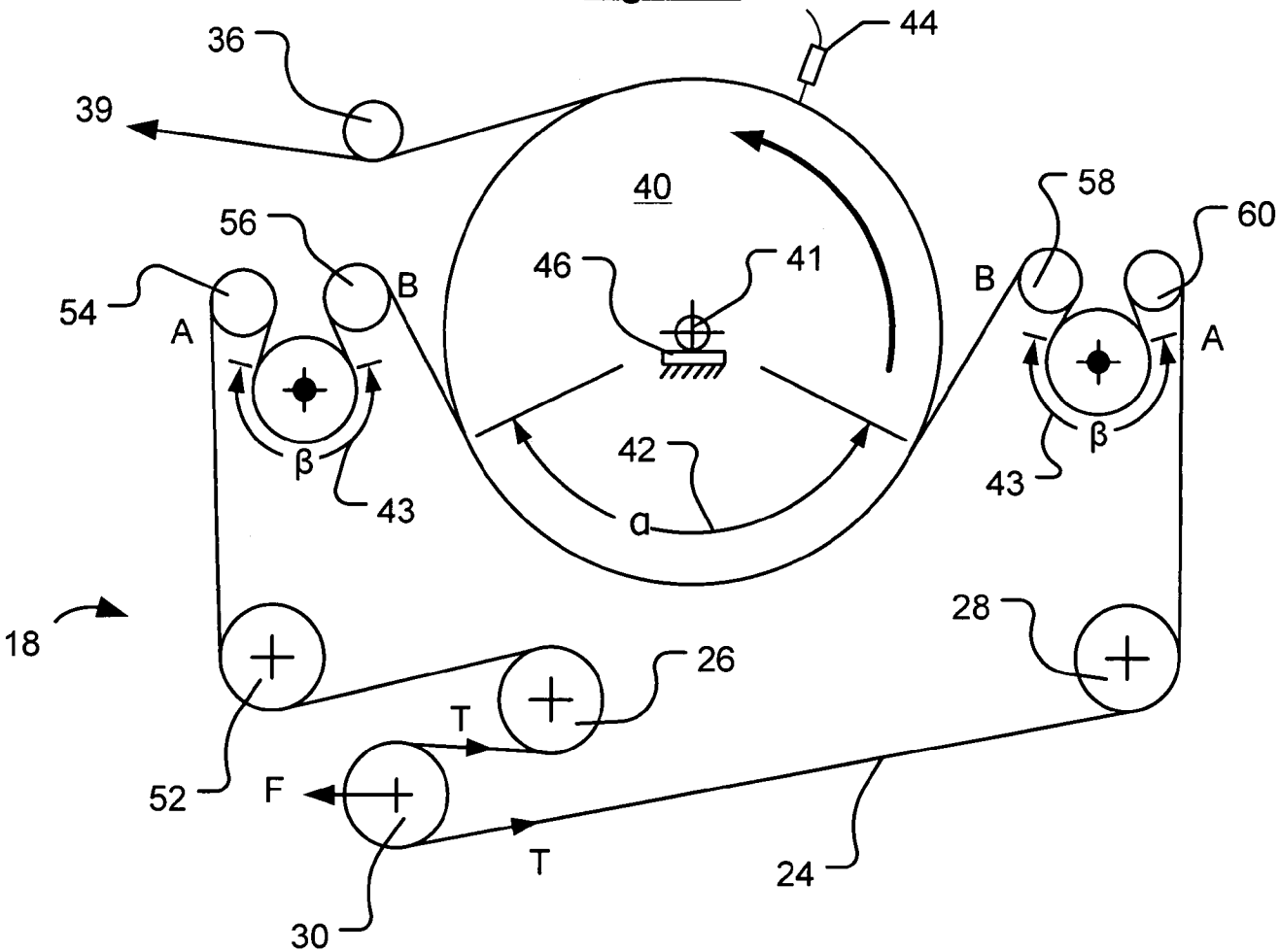
FIG. 2 illustrates an alternative embodiment of the unwind apparatus.

Referring to FIG. 2, an embodiment of the belt-driven unwind 18 using large wrap angles on the drive roller 20 and the brake roller 22, without using the nip rollers (32, 34) is illustrated. As discussed with the embodiment of FIG. 1, all of the various control methods and/or sensors can be used alone or in combination to adjust the pressure P exerted on the roll 40 by the belt(s) 24. The positions of the rollers in the unwind are fixed such that the roll 40 can be loaded or unloaded without having to change the position of the rollers. However, if desired, one or more of the rollers could translate or rotate, or both, to increase the roll wrap angle $\alpha$ when unwinding and then move out of position for loading or unloading the roll.

Instead of nip rollers (32, 34) to isolate the two belt tensions in paths A-A and B-B, the illustrated unwind uses additional guide rollers 54-60 to maintain large belt wrap angle $\beta$ (43) of the belt(s) 24 about the periphery of the drive roller 20 and the brake roller 22. The maximum belt wrap angle $\beta$ of the belt 24 about either the drive roller 20 or the brake roller 22 can be changed by adjusting the position of the various rollers (54, 56, 58, and 60) in the belt-driven unwind 18. In different embodiments of the invention, the maximum belt wrap angle $\beta$ for the belt-driven unwind can be between about 90 degrees to about 280 degrees, or between about 125 degrees to about 225 degrees, or between about 150 degrees to about 210 degrees. In the embodiment illustrated in FIG. 2, the maximum belt wrap angle $\beta$ about the drive roller and the brake roller is approximately 200 degrees.

Figure 3:
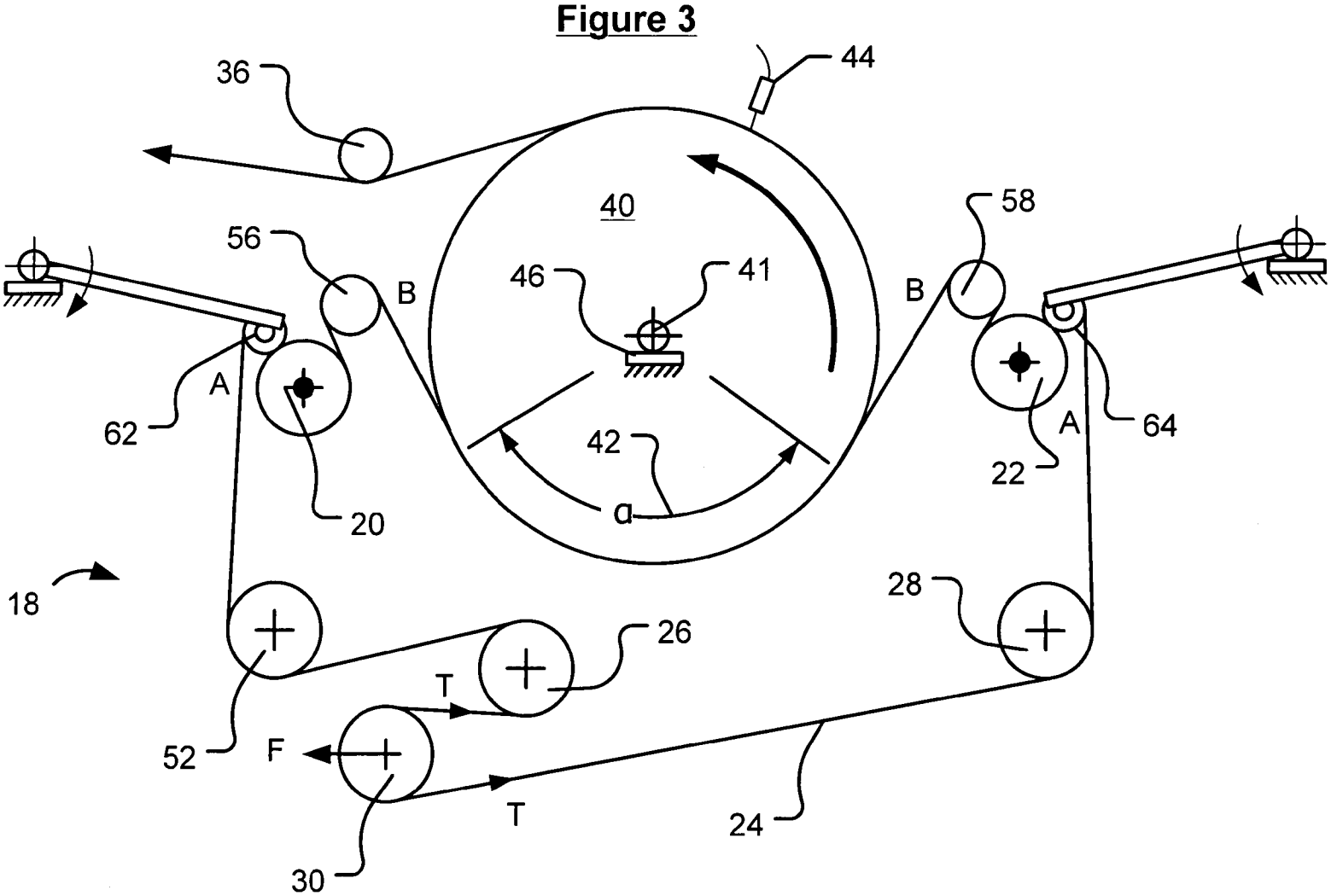
FIG. 3 illustrates another alternative embodiment of the unwind apparatus.

Referring to FIG. 3, an embodiment of the belt-driven unwind 18 using self-actuating nip rollers (62, 64) is illustrated. As discussed with the embodiment of FIG. 1, all of the various control methods and/or sensors can be used alone or in combination to adjust the pressure P exerted on the roll 40 by the belt(s) 24. The positions of the rollers in the unwind are fixed such that the roll 40 can be loaded or unloaded without having to change the position of the rollers. However, if desired, one or more of the rollers could translate or rotate, or both, to increase the roll wrap angle $\alpha$ when unwinding and then move out of position for loading or unloading the roll.

Instead of nip rollers (32, 34) to isolate the two belt tensions in paths A-A and B-B, the illustrated unwind uses additional guide rollers (56, 58) and self-actuating nip rollers (62, 64) to isolate the higher belt tension path A-A from the lower belt tension path B-B. As used herein "self-actuating" means that the roller is free to slide, translate, rotate, and/or pivot such that the belt's tension causes an increase to the nip load between the nip roller and the respective drive or brake roller. As seen in FIG. 3, the drive self-actuating nip roller 62 and the brake self-actuating nip roller 64 are rotatably mounted to pivoting arms. As such, the belt tension in path A-A combined with the belt's wrap about the self-actuating nip roller tends to force or pull the nip roller harder against the respective drive or brake roller. The self-actuating nip roller either alone or in combination with a sufficient belt wrap angle $\beta$ can be used to isolate the two tension zones (A-A, B-B).

In the various illustrated embodiments, the belt-driven unwind 18 can include a large roll wrap angle $\alpha$ (42). Conventional belt-driven unwinds typically have a maximum roll wrap angle $\alpha$ of between about 10 degrees to about 80 degrees. The driving force or tractive force that can be transmitted to the roll 40 without slippage increases sharply as a function of the roll wrap angle $\alpha$. The ability to transmit power to the roll 40 by the belt(s) 24 at the same belt tension increases exponentially with roll wrap angle $\alpha$. Therefore, the pressure P needed to keep the roll 40 from slipping during acceleration or deceleration can be greatly reduced if the roll wrap angle $\alpha$ is increased. Additionally, a large roll wrap angle $\alpha$ can help to reduce sheet velocity variations for out-of-round rolls during unwinding since more of the roll's surface is in contact with the belt and, therefore, supported by the belt. This can greatly diminish speed or tension variations in the sheet material being unwound for out-of-round rolls. The maximum roll wrap angle $\alpha$ can be changed by adjusting the position of the various rollers in the belt-driven unwind 18. In different embodiments of the invention, the maximum roll wrap angle $\alpha$ for the belt-driven unwind can be between about 90 degrees to about 280 degrees, or between about 125 degrees to about 225 degrees, or between about 150 degrees to about 210 degrees. In the embodiment illustrated in FIG. 1, the maximum roll wrap angle $\alpha$ is approximately 195 degrees.

The pressure P applied to the roll 40 by the belt(s) can be calculated since Pressure P (psi)=Belt Tension (pli)/Roll Radius (in). In various embodiments of the invention, the pressure P applied to the roll by the belt can be between about 0 psi to about 0.5 psi, or between about 0 psi to about 0.30 psi, or between about 0 psi to about 0.2 psi. As discussed above, the pressure P can be controlled in a number of ways, and, more importantly, can be much lower than in a conventional belt-driven unwind. Additionally, the pressure P can be controlled as a function of the acceleration rate, deceleration rate, or speed of the roll by appropriate controls. Thus, the pressure P can be higher initially and then be gradually decreased after the roll acceleration or deceleration is complete.

In the various embodiments, the belted-driven unwind 18 can have any number of belts and, desirably, has between 1 to about 5 belts located in the cross-machine direction of the belt-driven unwind. The belts can have any width, and desirably have a width of between about 1 inch to about 30 inches, or between about 4 inches to about 10 inches. Alternatively, the belts can cover a fixed percentage of the roll's width. In various embodiments, the belts can cover from between about 5 percent to about 50 percent of the roll's width, or between about 10 percent to about 40 percent of the roll's width, or between about 20 percent to about 30 percent of the roll's width. Suitable belt materials can include flat belts made from acrylonitrile-butadiene-rubber with a variety of traction materials applied to the face as manufactured by Habasit USA Corporation of Atlanta, Ga.

In the various embodiments, the rollers used in the belted-driven unwind 18 can be either live-shaft rollers, dead-shaft rollers, or a combination of both kinds. Suitable diameters for the rollers can be calculated based on the width of the roller, the loads applied to the roller, and the rotational speed of the roller. Suitable roller diameters can range from about 5 inches for narrow machines less than 40 inches wide to about 24 inches in diameter for machines less than 210 inches wide. The final diameter of the roller is generally based on its ability to limit deflection for proper guiding, as the stresses at low deflections are generally low. The rollers can be constructed from suitable materials such as iron, steel, stainless steel, aluminum, other metals, or composite materials, and may be covered, coated, or utilize other specific surface treatments. The surface treatments can be used to improve friction between the rollers and the belt(s), prolong the life of the belt(s), or assist with belt tracking.

For the purpose of belt tracking, one or more rollers in the belted-unwind can be crowned. Suitable crowns can be calculated based on the width of the belts, the diameter of the roller, the velocity of the belt, and the wrap angle of the belt about the roller. Alternatively, or in combination with crowning, one or more guide rollers in the belt-driven unwind can translate or rotate to control the position of the belt on the roller. For example, an end pivoted roller can be used in combination with a guide paddle or sensor that tracks the belt's position and adjusts the angular position of the guide roll to keep the belt centered on the guide roll. Suitable guide rollers are available from Fife Corporation.

While the apparatus illustrated in the Figures is being used as a belt-driven unwind, it will be appreciated by those of skill in the art that similar higher belt tension/lower belt tension principles discussed for unwinds can be applied to a belted winder. For example, the roll's rotational direction indicated in the Figures can be reversed and the apparatus used to wind roll 40 instead of unwinding it. In a general sense it can be seen that a low tension portion of the belt's travel path can be useful for a number of purposes related to the handling and converting of materials.

Other modifications and variations to the present invention may be practiced by those of ordinary skill in the art without departing from the spirit and scope of the present invention, which is more particularly set forth in the appended claims. It is understood that aspects of the various embodiments may be interchanged in whole or part. All cited references, patents, or patent applications in the above application for letters patent are herein incorporated by reference in a consistent manner. In the event of inconsistencies or contradictions between the incorporated references and this application, the information present in this application shall prevail. The preceding description, given by way of example in order to enable one of ordinary skill in the art to practice the claimed invention, is not to be construed as limiting the scope of the invention, which is defined by the claims and all equivalents thereto.

We claim:

1. An apparatus for winding a sheet material into a roll, said apparatus comprising:

a core shaft around which the sheet material is wound into a roll, a drive roller, a drive nip roller nipped against the drive roller, a brake roller, a brake nip roller nipped against the brake roller and an endless belt having an endless belt path which partially wraps the roll;

said endless belt configured to travel between the drive nip roller and the drive roller and to rotate about the drive roller;

said endless belt further configured to travel between the brake nip roller and the brake roller and to rotate about the brake roller; and wherein the drive roller advances the endless belt while the brake roller retards the endless belt so as to create a lower tension in the portion of the endless belt's path between the drive roller and the break roller that wraps the roll and a higher tension in the remaining portion of the endless belt's path between the brake roller and the drive roller that does not wrap the roll.

2. The apparatus of claim 1 wherein the nip rollers are self-actuating.

3. The apparatus of claim 1 comprising at least one guide roller and at least one stretch roller located within the portion of the endless belt's path having a higher tension.

4. The apparatus of claim 1 wherein the rotation of the endless belt is configured to unwind the roll.

5. The apparatus of claim 1 comprising a speed sensor configured to measure the speed of the roll, and wherein a signal from the speed sensor is used to control a force (F) applied to the stretch roller.

6. The apparatus of claim 1 comprising at least one load cell positioned to determine the weight of the roll and the pressure of the belt (P) against the roll, and wherein a signal from the load cell is used to control a force (F) applied to the stretch roller.

7. The apparatus of claim 1 wherein the endless belt wraps the roll and a roll wrap angle ($\alpha$) is between about 90 degrees to about 280 degrees.

8. The apparatus of claim 1 wherein the endless belt wraps the roll and the pressure (P) applied to the roll by the belt is between about 0 psi to about 0.5 psi.

9. The apparatus of claim 1 wherein the endless belt wraps the roll and the pressure (P) applied to the roll by the belt is between about 0 psi to about 0.3 psi.

10. A method for winding a sheet material into a roll comprising:

providing a core shaft around which the sheet material is wound into a roll, a drive roller, a drive nip roller nipped against the drive roller, a brake roller, a brake nip roller nipped against the brake roller, and an endless belt having an endless belt path;

said endless belt configured to travel between the drive nip roller and the drive roller and to rotate about the drive roller;

said endless belt further configured to travel between the brake nip roller and the brake roller and to rotate about the brake roller;

advancing the drive roller;

retarding the brake roller;

creating a lower tension in the portion of the endless belt's path between the drive roller and the break roller that wraps the roll; and creating a higher tension in the remaining portion of the endless belt's path between the brake roller and the drive roller that does not wrap the roll.

11. The method of claim 10 wherein the rotation of the belt is configured to unwind the roll.

12. The method of claim 11 comprising providing a stretch roller and a guide roller in the portion of the endless belt's path having a higher tension.

13. The method of claim 12 comprising adjusting a force (F) applied to the stretch roller to control the pressure (P) applied by the endless belt to the roll's surface.

* * * * *